US007768465B2

(12) United States Patent
Jared et al.

(10) Patent No.: US 7,768,465 B2
(45) Date of Patent: Aug. 3, 2010

(54) VEHICLE-MOUNT STACKED PATCH ANTENNA ASSEMBLIES WITH RESILIENTLY COMPRESSIBLE BUMPERS FOR MECHANICAL COMPRESSION TO AID IN ELECTRICAL GROUNDING OF SHIELD AND CHASSIS

(75) Inventors: Christopher J. Jared, Davison, MI (US); Philip J. Kekel, Saginaw, MI (US)

(73) Assignee: Laird Technologies, Inc., Chesterfield, MO (US)

( * ) Notice: Subject to any disclaimer, the term of this patent is extended or adjusted under 35 U.S.C. 154(b) by 564 days.

(21) Appl. No.: 11/867,241

(22) Filed: Oct. 4, 2007

(65) Prior Publication Data

US 2009/0066593 A1 Mar. 12, 2009

Related U.S. Application Data

(60) Provisional application No. 60/971,898, filed on Sep. 12, 2007.

(51) Int. Cl.
*H01Q 1/32* (2006.01)

(52) U.S. Cl. ..... 343/713; 343/872

(58) Field of Classification Search ..... 343/713, 343/711, 712, 872, 841
See application file for complete search history.

(56) References Cited

U.S. PATENT DOCUMENTS

| | | | | |
|---|---|---|---|---|
| 5,438,697 | A | 8/1995 | Fowler et al. | |
| 6,023,245 | A | 2/2000 | Gomez et al. | |
| 6,072,429 | A | 6/2000 | Crothall et al. | |
| D461,796 | S | 8/2002 | Boyer | |
| D465,480 | S | 11/2002 | Boyer | |
| 6,501,019 | B2 | 12/2002 | Sato et al. | |
| 6,522,291 | B1 | 2/2003 | Noguchi et al. | |
| 6,674,412 | B1 | 1/2004 | Schmidt et al. | |
| 6,762,727 | B2 | 7/2004 | Rochford et al. | |
| 6,840,780 | B1 | 1/2005 | Antaya et al. | |
| 6,879,294 | B2 | 4/2005 | Yuanzhu | |
| 6,930,643 | B2 | 8/2005 | Byrne et al. | |
| 7,212,168 | B2 * | 5/2007 | Kozlovski | 343/713 |
| 7,333,065 | B2 * | 2/2008 | Lindackers et al. | 343/713 |
| 2004/0257281 | A1 | 12/2004 | Noro et al. | |
| 2006/0110214 | A1 * | 5/2006 | Kozlovski | 403/252 |
| 2006/0244667 | A1 * | 11/2006 | Thompson et al. | 343/713 |
| 2006/0290580 | A1 | 12/2006 | Noro et al. | |
| 2007/0085361 | A1 | 4/2007 | Hauser | |
| 2007/0171138 | A1 | 7/2007 | Noro | |

FOREIGN PATENT DOCUMENTS

| | | |
|---|---|---|
| EP | 1699109 | 9/2006 |

* cited by examiner

*Primary Examiner*—HoangAnh T Le
(74) *Attorney, Agent, or Firm*—Harness, Dickey & Pierce, P.L.C.

(57) ABSTRACT

According to various aspects, exemplary embodiments are provided of antenna assemblies. In one exemplary embodiment, an antenna assembly suitable for installation to a vehicle body wall generally comprises a chassis, a radome, and a shield disposed generally between the chassis and radome. Two or more resiliently compressible bumpers are spaced apart and compressively sandwiched generally between the radome and the shield. Compression of the bumpers generates a compressive force urging the shield generally towards the chassis that aids in electrically grounding of the shield with the chassis.

20 Claims, 4 Drawing Sheets

VEHICLE-MOUNT STACKED PATCH ANTENNA ASSEMBLIES WITH RESILIENTLY COMPRESSIBLE BUMPERS FOR MECHANICAL COMPRESSION TO AID IN ELECTRICAL GROUNDING OF SHIELD AND CHASSIS

CROSS-REFERENCE TO RELATED APPLICATION

This application claims priority to U.S. Provisional Application Ser. No. 60/971,898 filed Sep. 12, 2007. The entire disclosure of U.S. Provisional Application Ser. No. 60/971,898 is hereby incorporated herein by reference in its entirety.

FIELD

The present disclosure generally relates to stacked patch antenna assemblies mountable to mobile platforms, such as automobile or vehicle roofs, hoods, or trunk lids.

BACKGROUND

The statements in this section merely provide background information related to the present disclosure and may not constitute prior art.

Various antenna types are used in the automotive industry, including aerial AM/FM antennas, patch antennas, etc. Antennas for automotive use are commonly positioned on the vehicle's roof, hood, or trunk lid to help ensure that the antenna has an unobstructed view overhead or towards the zenith.

By way of example, patch antennas are narrowband, wide-beam antennas that include active antenna elements bonded to dielectric substrates. Patch antennas typically have a relatively low profile compared to aerial antennas and are mechanically rugged. Patch antennas are therefore suitable for mounting on the exteriors of vehicles to receive satellite signals, such as Satellite Digital Audio Radio Services (SDARS). Patch antennas for automotive use are commonly positioned on the roof, hood, or trunk lid of the automobile to help ensure that the patch antennas have an unobstructed view overhead or towards the zenith.

Antenna assemblies typically also include a protective cover for sealing and encasing electrical components on a printed circuit board. The printed circuit board, in turn, is commonly fixed with screws to a die cast chassis or body of the antenna assembly. The body and cover are then installed, for example, to the vehicle roof. A rubber seal may be used to fill the gap or space between the protective cover and the vehicle roof.

SUMMARY

According to various aspects, exemplary embodiments are provided of antenna assemblies. In one exemplary embodiment, an antenna assembly suitable for installation to a vehicle body wall generally comprises a chassis, a radome, and a shield disposed generally between the chassis and radome. Two or more resiliently compressible bumpers are spaced apart and compressively sandwiched generally between the radome and the shield. Compression of the bumpers generates a compressive force urging the shield generally towards the chassis that aids in electrically grounding of the shield with the chassis.

In another exemplary embodiment, an antenna assembly is mountable on a vehicle wall after being positioned relative to a mounting hole in the vehicle wall from an external side of the vehicle and nipped from an interior compartment side of the vehicle. The antenna assembly generally comprises a chassis, a radome configured to be coupled to the chassis such that an interior enclosure is collectively defined by the radome and the chassis, and a shield disposed within the interior enclosure. Two or more spaced-apart resiliently compressible members are coupled to the radome. A first patch-antenna is tuned to a first frequency, and a second patch-antenna tuned to a second frequency. A low noise amplifier is within the interior enclosure for amplifying signals received by the first and second patch-antennas. Compression of the resiliently compressible members generates a compressive force urging the shield generally towards the chassis that aids in electrically grounding of the shield with the chassis.

Additional aspects relate to methods of installing an antenna assembly to a vehicle wall. The antenna assembly generally includes a chassis, a radome configured to be coupled to the chassis such that an interior enclosure is collectively defined by the radome and the chassis, a shield disposed within the interior enclosure, and an antenna element within the interior enclosure. The method generally comprises positioning two or more resiliently compressible bumpers at spaced apart locations generally between the radome and the shield, and compressing the bumpers by relatively moving the radome towards the chassis to thereby generate a compressive force urging the shield generally towards the chassis that aids in electrically grounding of the shield with the chassis.

Further aspects and features of the present disclosure will become apparent from the detailed description provided hereinafter. In addition, any one or more aspects of the present disclosure may be implemented individually or in any combination with any one or more of the other aspects of the present disclosure. It should be understood that the detailed description and specific examples, while indicating exemplary embodiments of the present disclosure, are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
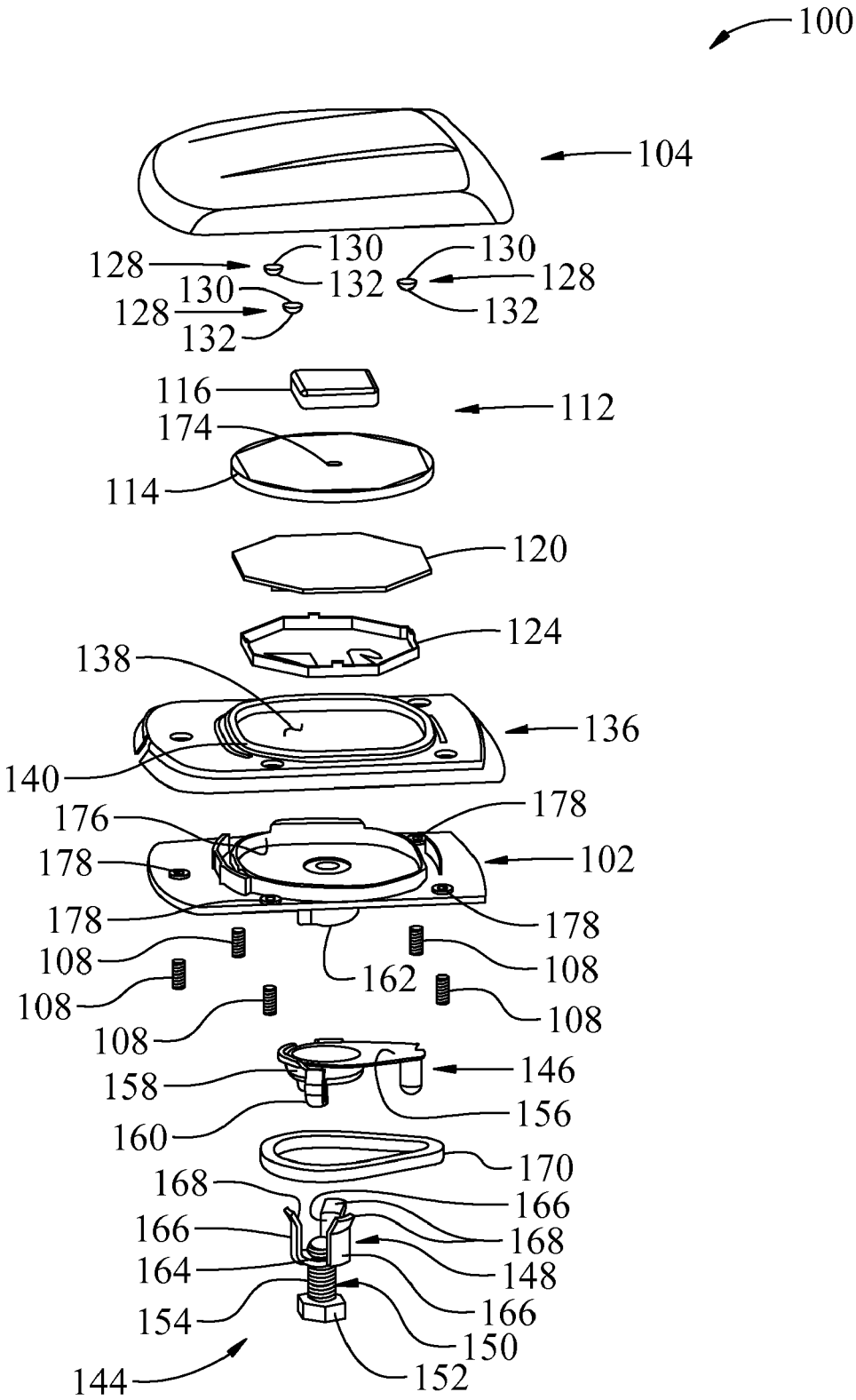
FIG. 1 is an exploded perspective view of an exemplary antenna assembly according to an exemplary embodiment.

The following description is merely exemplary in nature and is in no way intended to limit the present disclosure, application, or uses. It should be understood that throughout the drawings, corresponding reference numerals indicate like or corresponding parts and features.

With reference now to the drawings, FIGS. 1-4 illustrate an exemplary embodiment of an antenna assembly 100 suitable for installation to a vehicle body wall (not shown), such as a vehicle roof, trunk lid, hood, etc. The illustrated antenna assembly 100 may provide an improved ground connection for antenna elements within the assembly.

As shown in FIG. 1, the illustrated antenna assembly 100 generally includes a base (or chassis) 102 configured (e.g., sized, shaped, etc.) to be mounted on a vehicle body wall, and a protective environmental cover (or radome) 104 configured to cover the base 102. The cover 104 may be seated on the base 102 or may overlap the base 102 and substantially encase the base 102 within the scope of the present disclosure. Fasteners 108 are provided to fasten the cover 104 to the base 102. As will be described in more detail hereinafter, the fasteners 108 extend through the base 102 and into the cover 104 to fasten the cover 104 to the base 102. The fasteners 108 may include, for example, mechanical fasteners such as screws, bolts, etc. within the scope of the present disclosure. In other exemplary embodiments, antenna assemblies may include covers that fasten to bases differently than illustrated and described herein. For example, covers may fasten to bases by snap-fit fasteners, etc.

The cover 104 may be formed from a wide range of materials, such as polymers, urethanes, plastic materials (e.g., polycarbonate blends, Polycarbonate-Acrylnitril-Butadien-Styrol-Copolymer (PC/ABS) blend, etc.), glass-reinforced plastic materials, synthetic resin materials, thermoplastic materials (e.g., GE Plastics Geloy® XP4034 Resin, etc.), among other suitable materials. And the base 102 may be formed from metal. For example, the base 102 may be die cast from zinc. Alternatively, the base 102 may be formed by a different process other than die casting, and/or may be formed from a different material or composite of materials within the scope of the present disclosure.

A stacked antenna assembly 112 is disposed within an interior enclosure collectively defined by the antenna cover 104 and base 102. In the illustrated embodiment, the stacked assembly 112 includes a first lower patch antenna element 114 and a second upper patch antenna element 116. The illustrated antenna elements 114, 116 are generally vertically stacked and may be positioned on a shared circuit board. Alternatively, each antenna element 114, 116 may be positioned on a respective circuit board within the scope of the present disclosure. The first patch antenna element 114 may be tuned to a first frequency (e.g., a satellite digital radio service, etc.), and the second patch antenna element 116 may be tuned to a second frequency (e.g., a global positioning system, etc.). For example, in the illustrated antenna assembly 100, the first patch antenna element 114 may include a ceramic Satellite Digital Audio Radio Services (SDARS) patch antenna for receiving frequencies used by SDARS (e.g., 2.320 GHz to 2.3325 345 GHz for SIRIUS Satellite Radio Service, 2.3325 GHz to 2.345 GHz for XM Satellite Radio Service, etc.), and the second patch antenna element 116 may include a ceramic Global Positioning System (GPS) patch antenna for receiving frequencies used by GPS (e.g., at least 1.575 GHz, etc.).

It is understood that the stacked antenna assembly 112 may include a different number of antenna elements other than two antenna elements, for example one antenna element, within the scope of the present disclosure. In addition, the antenna elements may be oriented in configurations other than stacked configurations. For example, the antenna elements may be oriented in generally side-by-side configurations. Further, other antennas and/or antenna elements may be used within the scope of the present disclosure.

A low noise amplifier (LNA) 120 is located generally below the stacked antenna assembly 112 for amplifying signals received by the first and/or second antenna element 114, 116. More particularly in the illustrated embodiment, the LNA 120 is located generally below the first antenna element 114.

A shield 124 is disposed generally below the LNA 120 (and broadly between the cover 104 and the base 102) for receiving at least part of the LNA 120 and at least part of the first and second antenna elements 114, 116 therein. The shield 124 is configured to contact the base 102 when the antenna assembly 100 is assembled to provide a ground contact with the base 102 as well as electromagnetic interference (EMI) and/or radio frequency interference (RFI) shielding to the LNA 120 and antenna elements 114, 116. The shield 124 may be formed from a wide range of electrically-conductive materials. By way of example, the shield 124 may be formed from cold rolled steel, nickel-silver alloys, copper-nickel alloys, stainless steel, tin-plated cold rolled steel, tin-plated copper alloys, carbon steel, brass, copper, aluminum, copper-beryllium alloys, phosphor bronze, steel, alloys thereof, or any other suitable electrically-conductive and/or magnetic materials. In addition, the shield 124 may be formed from a plastic material coated with electrically-conductive material within the scope of the present disclosure.

Figure 2:
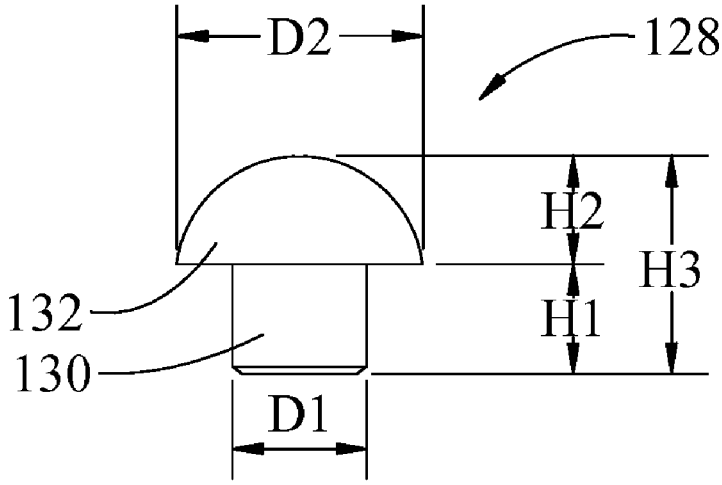
FIG. 2 is a side elevation view of an exemplary bumper of the antenna assembly illustrated in FIG. 1.
Figure 3:
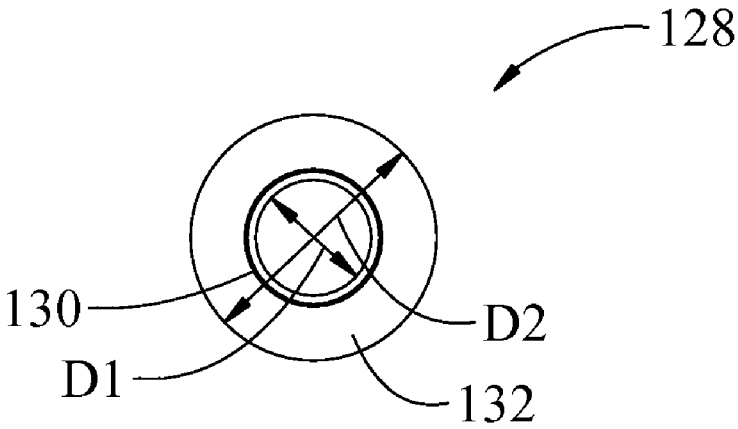
FIG. 3 is a bottom plan view of the bumper of FIG. 2.

With additional reference to FIGS. 2 and 3, the antenna assembly 100 also includes multiple resiliently compressible members, or bumpers, 128 located generally between the cover 104 and the stacked antenna assembly 112 (broadly, between the cover 104 and the shield 124). The bumpers 128 can engage, for example, the first and/or second patch antenna element 114, 116 when the base 102 and cover 104 are moved together during assembly. And the bumpers 128 may compress (e.g., shorten in a longitudinal direction, etc.) between the cover 104 and the antenna elements 114, 116 and provide a generally constant force against the antenna elements 114, 116. This force presses the antenna elements and LNA 120 against the shield 124 and can provide an improved ground connection for the shield 124 with the antenna base 102 (as the shield 124 is also pressed against the base 102 by the bumper force). In the illustrated embodiment, the bumpers 128 engage the first patch antenna element 114 when the base 102 and cover 104 are moved together during assembly (FIG. 4).

In the illustrated embodiment, the resiliently compressible bumpers 128 include silicone bumpers 128 that have a generally ogival shape. The silicone bumpers 128 may be formed from silicone rubber (VMQ). Three bumpers 128 are coupled to an underside of the cover 104 at spaced apart locations along the cover 104. The three bumpers 128 are located within a generally horizontal plane. Two bumpers 128 are coupled to the cover 104 toward a forward end of the cover 104, and one bumper 128 is coupled to the cover 104 toward a rearward end of the cover 104. The ogival shape of each bumper may include, for example, a cylindrical base 130 (e.g., FIG. 2, etc.) that can be coupled to the cover 104, and a generally mushroom-shaped ogival tip 132. The ogival tip 132 of each bumper 128 faces generally away from the cover 104 for engaging and pressing against the first and/or second patch antenna element 114, 116 when the antenna assembly 100 is assembled (FIG. 4). As shown in FIGS. 2 and 3, the base 130 of each illustrated bumper 128 may include a diameter D1 of about 2.1 millimeters and a height H1 of about 1.75 millimeters. The ogival tip 132 of each illustrated bumper 128 may include a diameter D2 of about 4 millimeters and a height H2 of about 1.75 millimeters. The overall height H3 of each illustrated bumper 128 is about 3.5 millimeters. Bumpers may have other dimensions within the scope of the present disclosure.

Figure 4:
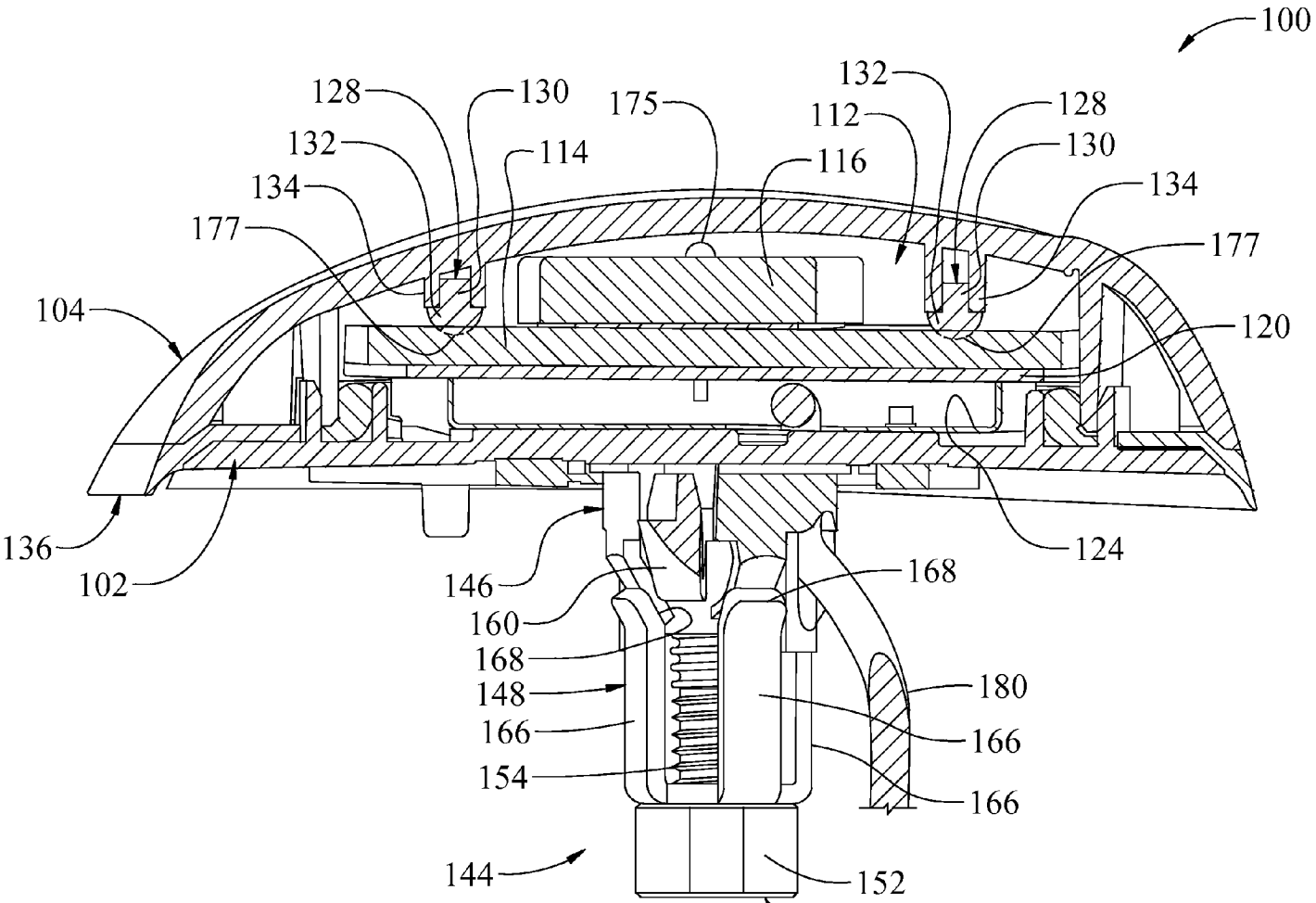
FIG. 4 is a side elevation view of the antenna assembly of FIG. 1 in an assembled configuration and with part of the assembly broken away.

The bumpers 128 may be received by the cover 104 in, for example, sockets 134 formed in the cover 104 (FIG. 4). The base 130 of each bumper 128 may be received within a respective socket 134, and the ogival tip 132 of each bumper 128 may extend at least partly out of the socket 134 to engage at least one of the patch antenna elements 114, 116 (e.g., the first patch antenna element 114, etc.). The bumpers 128 may be coupled to the cover 104 within the sockets 134 by, for example, adhesive material, hook and loop fasteners, friction fit, etc. within the scope of the present disclosure.

In other exemplary embodiments, antenna assemblies may include bumpers having other than ogival shapes. For example, the bumpers may include prism shapes, cubic shapes, spherical shapes, frusto-conical shapes, dome shapes, semi-spheroidal shapes, ogival/bullet shapes, etc. Further, the bumpers may be coupled to covers of the antenna assemblies at locations other than sockets. For example, the bumpers may be coupled directly to undersides/lower surfaces of the covers (independent of sockets). In still other exemplary embodiments, antenna assemblies may include bumpers formed from material other than silicone. For example, bumpers may be formed from one or more material having sufficient resiliency to permit compression thereof and to respond with a sufficient restorative force for helping maintain electrical grounding of shields to bases of the antenna assemblies. This can include, but is not limited to, rubber (e.g., ethylene propylene diene monomer (EPDM) rubber, etc.), other silicone composites, etc.

The interior enclosure collectively defined by the cover 104 and the base 102 of the illustrated antenna assembly 100 is substantially sealed by, for example, a seal 136 located generally between the cover 104 and the base 102. The seal 136 may contact the base 102 and substantially seal the interface defined generally between the cover 104 and the base 102 to preferably inhibit the ingress of contaminants (e.g., dust, moisture, etc.) into the interior enclosure in which the antenna elements 114, 116, the LNA 120, and the shield 124 are disposed. In the illustrated embodiment, the seal 136 is configured to fit generally over the base 102 and includes an opening 138 therein to receive at least part of the antenna elements 114, 116, the LNA 120, and the shield 124 when the antenna assembly 100 is assembled. In addition, the cover 104 may engage an upper edge 140 of the opening 138 to further seal the interior enclosure.

The seal 136 may be formed from a wide range of materials, such as resilient materials, polymers, urethanes, plastic materials (e.g., polycarbonate blends, Polycarbonate-Acryinitril-Butadien-Styrol-Copolymer (PC/ABS) blend, etc.), glass-reinforced plastic materials, synthetic resin materials, thermoplastic materials (e.g., GE Plastics Geloy® XP4034 Resin, etc.), among other suitable materials, within the scope of the present disclosure. Alternative embodiments may include seals formed from other materials and/or seals that are integrally defined by antenna covers and/or bases.

A mounting assembly 144 is provided generally below the base 102 for mounting and/or securing the antenna assembly 100 to a vehicle body wall. The mounting assembly 144 generally includes a first upper retaining component 146, a second lower retaining component 148, and a fastener 150. The fastener 150 includes a threaded bolt having a hexagonal head 152 and a threaded portion 154 extending away from the head 152. As will be described in more detail hereinafter, the threaded portion 154 of the fastener 150 extends through the first and second retaining components 146, 148 and threads into the base 102 to mount and/or secure the antenna assembly 100 to the vehicle body wall.

The first retaining component 146 of the illustrated mounting assembly 144 generally includes a platform 156 and a bowl-shaped depression 158 extending generally downwardly from the platform. Positioning clips 160 (only one is visible) are located generally around a perimeter of the platform 156 for use in locating and/or supporting the first retaining component 146 in an opening, or hole, in a vehicle body wall to which the antenna assembly 100 is to be mounted. For example, the first retaining component 146 may be positioned in the opening in the vehicle body wall so that the platform 156 is generally flush with an external side of the vehicle body wall and the positioning clips 160 are at least partly within the opening. When the antenna assembly 100 is assembled, the bowl-shaped depression 158 of the first retaining component 146 is configured to receive a downwardly extending mounting projection 162 of the base 102 to properly position the base 102 above the first retaining component 146 (and over the opening in the vehicle body wall).

The second retaining component of the illustrated mounting assembly 144 generally includes an opening 164 and three resilient legs 166 extending generally away from the second retaining component at locations around the opening 164. The legs 166 each include a cam surface 168 configured to contact the bowl-shaped depression 158 of the first retaining component 146 and ultimately engage at least part of an internal side of the vehicle body wall when the antenna assembly 100 is installed thereto.

A sealing member 170 (e.g., an O-ring, a foam gasket, etc.) is also provided for substantially sealing the underside of the base 102 against an external side of a vehicle body wall. As shown in FIG. 1, the sealing member 170 is generally annular in shape and may be seated, for example, within a groove generally surrounding the mounting projection 162 of the base 102. When the antenna assembly 100 is installed to the vehicle body wall, the sealing member 170 may engage the vehicle body wall around an antenna mounting opening in the wall and/or may sit at least partly within the antenna mounting opening. Preferably, the sealing member 170 prevents (or at least inhibits) the ingress or penetration of water, moisture, dust, or other contaminants through the antenna mounting opening into an interior of the vehicle.

An exemplary process will now be described with additional reference to FIG. 4 for assembling the antenna assembly 100, including fastening the cover 104 to the base 102 and then installing the interconnected cover 104 and base 102 to a vehicle body wall at an antenna mounting opening in the wall. In other exemplary processes, the base 102 may first be installed to the vehicle body wall, and then the cover 104 may be fastened to the base 102.

First, the first and second patch antenna elements 114, 116 may be connected to form the stacked antenna assembly 112. For example, the second antenna element 116 may connect to the first antenna element 114 at an opening 174 therein. A fastener 175 may extend downwardly from the second antenna element 116 (e.g., through the second antenna element 116, etc.) and be configured for reception within the opening 174 of the first antenna element 114. The fastener 175 may be coupled to the first antenna element 114 and/or the second antenna element 116 by, for example, soldering, etc. The fastener 175 may alternatively be formed as part of the second antenna element 116 and/or first antenna element 114, or may be formed separate from the second antenna element 116 and/or first antenna element 114 and coupled thereto (e.g., soldered, etc.). In other exemplary embodiments, antenna assemblies may include antenna elements that interconnect differently than shown and described herein. For example, antenna elements may be interconnected by, for example, a direct solder, suitable welds, etc.

Next, the stacked antenna assembly 112 may be positioned on an upper surface of the LNA 120. And the stacked antenna assembly 112 and LNA 120 may then be positioned at least partly within the shield 124. The stacked antenna assembly 112 may be coupled/attached to the LNA 120 by the fastener 175, and the stacked antenna assembly 112 and LNA 120 may be coupled/attached to the shield 124 by, for example, a solder connection, etc. In other exemplary embodiments, however, the stacked antenna assembly 112 may be coupled/attached to the LNA 120 by, for example, mechanical fasteners, solder, suitable welds, combinations thereof, etc., and/or one or more of the stacked antenna assembly 112 and LNA 120 may be coupled/attached to the shield 124 by, for example, mechanical fasteners, solder, suitable welds, combinations thereof, etc.

The stacked antenna assembly 112, the LNA 120, and the shield 124 may then be centrally positioned within a receptacle 176 in the base 102. The shield 124 is not coupled/attached to the base 102, but may be coupled/attached thereto within the scope of the present disclosure. Contact between the shield 124 and the base 102 (and through the base 102 being installed to the vehicle body wall) provide a ground for the shield 124 for effectively shielding the LNA 120 and stacked antenna elements 114, 116 against EMI and RFI.

Next, the seal 136 can be positioned over (and at least partly around) the base 102, with the opening 138 therein located generally over the base's receptacle 176 (and generally over the stacked antenna assembly 112, the LNA 120, and the shield 124 received in the base's receptacle 176). The cover 104 can then be positioned over the seal 136 and the base 102 and initially moved together with the base 102 (e.g., by manual operation, by automated operation, etc.). As the cover 104 and base 102 are moved together, the ogival tips 132 of the bumpers 128 of the cover 104 each engage the stacked antenna assembly 112 at about the same time (the illustrated bumpers 128 are each about the same height). The bumpers 128 press the patch antenna elements 114, 116 and LNA 120 generally downwardly toward the shield 124, which in turn press the shield 124 generally downwardly against the base 102. During this movement, a space between the cover 104 and the patch antenna elements may reduce, and the bumpers 128 may compress. The illustrated bumpers 128 may compress about fifteen percent (by volume). This compression is generally shown with broken lines in FIG. 4 at 177. In other exemplary embodiments, bumpers may compress more than or less than fifteen percent (by volume). The compressed bumpers 128 apply a generally constant downward force against the antenna elements 114, 116. This force generally constantly presses the antenna elements 114, 116 and LNA 120 downwardly against the shield 124, and the shield 124 downwardly against the base 102 to possibly improve the electrical ground connection between the shield 124 and base 102.

The fasteners 108 may finally be inserted through aligned fastener openings 178 in the base 102, seal 136, and cover 104 to finish fastening the cover 104 to the base 102. The fasteners 108 may thread through the openings 178 in the base 102 and through the openings 178 in the seal 136, and then into the openings (not shown) in the cover 104. As the fasteners 108 are threaded into the cover openings, they draw the cover 104 and base 102 together. This further compresses the bumpers 128 against the stacked antenna assembly 112. Again, this compressive force from the bumpers 128 presses the antenna elements 114, 116 and the LNA 120 against the shield 124, which in turn press the shield 124 securely against the base 102. Thus, reliable contact may be maintained between the shield 124 and the base 102 to aid in electrically grounding the shield 124 with the base 102.

It should be appreciated that, in the illustrated embodiment, the LNA 120 is retained generally between the shield 124 and the cover 104 (and more particularly, between the shield 124 and the first patch antenna element 114) without mechanical fasteners directly fastening/attaching the LNA 120 to the shield 124 and/or base 102. Thus, the compression of the bumpers 128 generates the compressive force pressing the LNA 120 (and the antenna elements 114, 116) against the shield 124, and the shield 124 against the base 102 (both before and after the fasteners 108 are inserted). It should also be appreciated that the compressive force applied by the bumpers 128 is generated by the compression of the bumpers 128 generally between the cover 104 and the patch antenna elements 114, 116 (and more broadly, between the base 102 and the cover 104) when the base 102 and the cover 104 are initially relatively positioned adjacent to each other to be finally fastened via the fasteners 108. And this compressive force is generally maintained (and possibly increased) by the bumpers 128 after the fasteners 108 are applied to the cover 104 and base 102 to fasten the cover 104 to the base 102.

Once the cover 104 is fastened to the base 102, the fastened cover 104 and base 102 may be installed to the vehicle body wall at the antenna mounting opening formed in the wall. From an external side of the vehicle body wall, the threaded portion 154 of the fastener 150 is positioned through the opening 164 in the second retaining component 148, through an opening (not visible) in the bowl-shaped depression 158 of the first retaining component 146, and then threadingly engaged into a correspondingly threaded opening (not visible) associated with the mounting projection 162 of the base 102. The base's threaded opening may comprise a threaded insert or threaded member that is separately attached or coupled to the base 102. Or, for example, the threaded opening may be integrally defined or formed with the base 102. When the fastener 150 is thus threaded into the base's threaded opening, it captures the second retaining component 148 and the first retaining component 146 against the base 102. The mounting projection 162 of the base 102 is received within the bowl-shaped depression 158 of the first retaining component 146, and the cam surfaces 168 of the legs 166 of the second retaining component 148 generally engage the first retaining component's bowl-shaped depression 158.

The antenna assembly 100 may now be positioned as a single unit in the antenna mounting opening formed in the vehicle body wall. The first and second retaining components 146, 148 and the fastener 150, now connected (at least initially) to the base 102, should not fall or drop out as the antenna assembly 100 is being positioned. Capturing the components in this exemplary manner allows the installer (from outside the vehicle) to easily position the antenna assembly 100 as a single unit relative to the antenna mounting opening. This may advantageously allow for a reduction in the number of operations or steps needed for antenna installation as compared to those installation methods in which there is no such capturing of the fastener and retaining components.

As the antenna assembly 100 is moved downwardly relative to the vehicle mounting opening during positioning, the fastener 150 and the second retaining component 148 move through the antenna mounting opening and generally into the interior of the vehicle. Connecting cables, for example cable 180 in FIG. 4, may also move through the antenna mounting opening and generally into the interior of the vehicle. The legs 166 of the second retaining component 148 are configured such that they will not catch the inside of the antenna mounting opening as they are inserted through the opening. The positioning clips 160 of the first retaining component 146 then move into the vehicle mounting opening and seat the first retaining component 146 generally in the opening (so that the platform 156 is generally flush with an external side of the vehicle body wall and the positioning clips 160 are positioned at least partly within the opening).

At this stage of the installation process, the antenna assembly 100 is temporarily held in place by virtue of the interaction of the positioning clips 160 of the first retaining component 146, the vehicle body wall, and the antenna base 102. In addition, lower edges of the cover 104 may loosely abut the vehicle body wall. The antenna assembly 100 may now be nipped from the interior of the vehicle.

The installer may now enter the vehicle to access the head 152 of the fastener 150 using, for example, a socket wrench or other suitable tool to grip the hexagonal head 152 and rotate and tighten the fastener 150. As the fastener 150 rotates, it threads into the corresponding threaded opening associated with the mounting projection 162 of the antenna base 102. Alternative embodiments may include other suitable driving elements, fasteners, bolts having differently-shaped or non-hexagonal heads, etc. The rotating fastener 150 pulls the second and first retaining components 148, 146 upwardly toward the internal side of the vehicle body wall while at about the same time pulls the antenna base 102 downward toward the exterior side of the vehicle body wall. The cam surfaces 168 of the legs 166 of the second retaining component 148 engage the bowl-shaped depression 158 of the first retaining component 146 and move/deform/expand the legs generally outwardly as the fastener 150 pulls the second retaining component 148 upwardly.

Continued movement of the fastener 150 moves the legs 166 further outwardly and into contact with the internal side of the vehicle body wall. It should be appreciated that this outward movement and flexing of the legs 166 may provide a relatively secure engagement between the cam surfaces 168 of the legs 166 and the internal side of the vehicle body wall. The continued movement of the fastener 150 also pulls the antenna base 102 (and the sealing member 170 seated therein) downwardly into contact with the external surface of the vehicle body wall. The sealing member 170 may engage the vehicle body wall around the antenna mounting opening and prevent (or at least inhibit) the ingress or penetration of water, moisture, dust, or other contaminants through the antenna mounting opening into an interior of the vehicle. Together, the antenna base 102 and the legs 166 of the second retaining component 148 securely hold the antenna assembly 100 against (e.g., squeezed against, etc.) the vehicle body wall. Lower edges of the cover 104 may also be drawn securely against the vehicle body wall.

Figure 5:
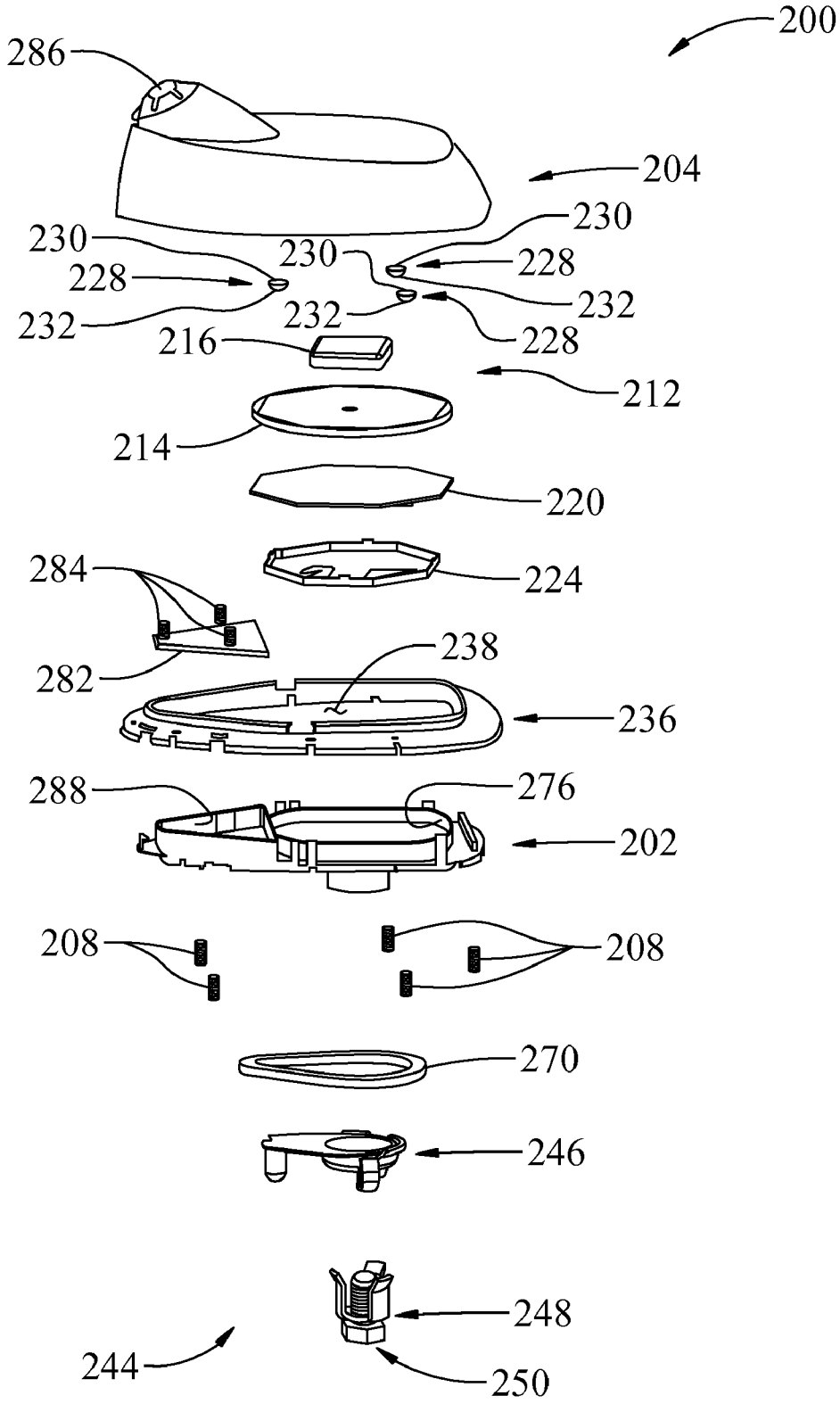
FIG. 5 is an exploded perspective view of an exemplary antenna assembly according to an alternative embodiment.

FIG. 5 illustrates another exemplary embodiment of an antenna assembly 200 suitable for installation to a vehicle body wall, such as a vehicle roof, trunk lid, hood, etc. The illustrated antenna assembly 200 is similar to the antenna assembly 100 previously described and illustrated in FIGS. 1-4, and again may provide an improved ground connection for antenna elements within the assembly. In this embodiment, the antenna assembly 200 generally includes a base (or chassis) 202 configured (e.g., sized, shaped, etc.) to be mounted on a vehicle body wall, and a protective environmental cover (or radome) 204 configured to cover the base 202. Fasteners 208 are provided to fasten the cover 204 to the base 202.

A stacked antenna assembly 212 is disposed within an interior enclosure collectively defined by the antenna cover 204 and base 202. In the illustrated embodiment, the stacked assembly 212 includes a first lower patch antenna element 214 and a second upper patch antenna element 216. The first patch antenna element 214 may be tuned to a first frequency (e.g., a satellite digital radio service, etc.), and the second patch antenna element 216 may be tuned to a second frequency (e.g., a global positioning system, etc.). For example, in the illustrated antenna assembly 200, the first patch antenna element 214 may include a ceramic SDARS patch antenna for receiving frequencies used by SDARS, and the second patch antenna element 216 may include a ceramic GPS patch antenna for receiving frequencies used by GPS.

A low noise amplifier (LNA) 220 is located generally below the stacked antenna assembly 212 for amplifying signals received by the first and/or second antenna element 214, 216. More particularly in the illustrated embodiment, the LNA 220 is located generally below the first antenna element 214. And a shield 224 is disposed generally below the LNA 220 (and broadly between the cover 204 and the base 202) for receiving at least part of the LNA 220 and at least part of the first and second antenna elements 214, 216 therein. The shield 224 is configured to contact the base 202 when the antenna assembly 200 is assembled to provide a ground contact with the base 202 as well as EMI and/or RFI shielding to the LNA 220 and antenna elements 214, 216.

In the illustrated embodiment, an antenna mount 282 is located adjacent the stacked antenna assembly 212 for connecting an antenna mast (not shown) to the antenna assembly 200. The antenna mast may, for example, be used for reception of AM/FM radio signals. The antenna mount 282 includes three fasteners 284 for fastening the antenna mast thereto. And as will be described more hereinafter, the antenna mount 282 is configured to fit within the base 202 along with the shield 224, the LNA 220, and the stacked antenna assembly 212. The antenna mast connects to the antenna mount 282 via the fasteners 284 and extends away from the antenna mast through a mast opening 286 in the antenna cover 204. The opening 286 may include a seal to prevent (or at least inhibit) the ingress or penetration of water, moisture, dust, or other contaminants through the opening 286 into the interior enclosure collectively defined by the antenna cover 204 and base 202. In other exemplary embodiments, antenna assemblies may include two or more antenna masts within the scope of the present disclosure.

The antenna assembly 200 also includes multiple resiliently compressible members, or bumpers, 228 located generally between the cover 204 and the stacked antenna assembly 212 (broadly, between the cover 204 and the shield 224). The bumpers 228 can engage, for example, the first and/or second patch antenna element 214, 216 when the base 202 and cover 204 are moved together during assembly. The bumpers 228 may compress (e.g., shorten in a longitudinal direction, etc.) between the cover 204 and the antenna elements 214, 216 and provide a generally constant force to the antenna elements 214, 216. This presses the antenna elements 214, 216 and LNA 220 against the shield 224 and can provide an improved ground connection between the shield 224 and the base 202.

In the illustrated embodiment, the resiliently compressible bumpers 228 include silicone bumpers 228 that have a generally ogival shape. Three bumpers 228 are coupled to an underside of the cover 204 at spaced apart locations along the cover 204. The three bumpers 228 are located within a generally horizontal plane. Two bumpers 228 are coupled to the cover 204 toward a forward end of the cover 204, and one bumper 228 is coupled to the cover 204 toward a rearward end of the cover 204. The ogival shape of each bumper 228 may include, for example, a base 230 that can be coupled to the cover 204, and a generally ogival tip 232. The ogival tip 232 of each bumper 228 faces generally away from the cover 204 for engaging and pressing against the first and/or second patch antenna element 214, 216 when the antenna assembly 200 is assembled.

The interior enclosure collectively defined by the cover 204 and the base 202 of the illustrated antenna assembly 200 is substantially sealed by, for example, a seal 236 located generally between the cover 204 and the base 202. And a mounting assembly 244 is provided generally below the base 202 for mounting and/or securing the antenna assembly 200 to a vehicle body wall. The mounting assembly generally includes a first upper retaining component 246, a second lower retaining component 248, and a fastener 250. A sealing member 270 (e.g., an O-ring, a foam gasket, etc.) is also provided for substantially sealing the underside of the base 202 against an external side of a vehicle body wall.

The antenna assembly 200 of this embodiment may be assembled similarly to the antenna assembly 100 previously described and illustrated in FIGS. 1-4. For example, the first and second patch antenna elements 214, 216 may first be connected to form the stacked antenna assembly 212. Next, the stacked antenna assembly 212 may be positioned on an upper surface of the LNA 220. And the stacked antenna assembly 212 and LNA 220 may then be positioned at least partly within the shield 224. The stacked antenna assembly 212, the LNA 220, and the shield 224 may then be centrally positioned within a first receptacle 276 in the base 202. As described for the antenna assembly 100 of the previous embodiment, contact between the shield 224 and the base 202 (and through the base 202 being installed to the vehicle body wall) of this antenna assembly 200 provide a ground for the shield 224 for effectively shielding the LNA 220 and stacked antenna elements 214, 216 against EMI and RFI. The antenna mast may be fastened to the antenna mount 282. And the antenna mount 282 (with the antenna mast fastened thereto) may be positioned within a second receptacle 288 in the base 202 (generally next to the first receptacle 276).

Next, the seal 236 can be positioned over (and at least partly around) the base 202, with an opening 238 therein located generally over the base's first and second receptacles 276, 288 (and generally over the stacked antenna assembly 212, the LNA 220, and the shield 224 received in the base's receptacles). The antenna mast can then be positioned through the mast opening 286 in the antenna cover 204, and the cover 204 can be positioned over the seal 236 and the base 202 and moved together with the base 202 (e.g., by manual operation, by automated operation, etc.). As the cover 204 and base 202 are moved together, the ogival tips 232 of the bumpers 228 of the cover 204 each engage the stacked antenna assembly 212 at about the same time. The bumpers 228 press the patch antenna elements 214, 216 and LNA 220 generally downwardly toward the shield 224, which in turn press the shield 224 generally downwardly against the base 202. During this movement, a space between the cover 204 and the patch antenna elements 214, 216 may reduce, and the bumpers 228 may compress. The compressed bumpers 228 apply a generally constant downward force against the antenna elements 214, 216. This force generally constantly presses the antenna elements 214, 216 and LNA 220 downwardly against the shield 224, and the shield 224 downwardly against the base 202 to possibly improve the electrical ground connection between the shield 224 and base 202.

The fasteners 208 may finally be inserted through aligned fastener openings 278 in the base 202, the seal 236, and the cover 204 to finish fastening the cover 204 to the base 202. The fasteners 208 may thread through the openings 278 in the base 202 and through the openings 278 in the seal 236, and then into the openings (not shown) in the cover 204. As the fasteners 208 are threaded into the cover openings, they draw the cover 204 and base 202 together. This further compresses the bumpers 228 against the stacked antenna assembly 212. The compressive force from the bumpers 228 presses the antenna elements 214, 216 and the LNA 220 against the shield 224, in turn pressing the shield 224 securely against the base 202. Reliable contact may thus be maintained between the shield 224 and the base 202 to aid in electrically grounding the shield 224 with the base 202.

Once the cover 204 is fastened to the base 202, the fastened cover 204 and base 202 may be installed to a vehicle body wall at an antenna mounting opening formed in the wall. This can be done by similar processes to those previously described for the antenna assembly 100 illustrated in FIGS. 1-4.

In other exemplary embodiments, antenna assemblies may include antenna bases with electrical connectors for communicating signals received by the antenna assemblies to other devices (e.g., a radio receiver, GPS receiver, SDARS receiver, etc.). In some embodiments, the electrical connectors may include standard ISO electrical connectors or Fakra connectors attached to the antenna bases. Here, coaxial cables may be relatively easily connected to the antenna assemblies. The coaxial cables may be used for communicating the signals received by the antenna assemblies to the other devices. In such embodiments, the use of standard ISO electrical connectors or Fakra connectors may allow for reduced costs as compared to those antenna installations that require a customized design and tooling for the electrical connection between the antenna assembly and cable. In addition, the pluggable electrical connections between the communication links and the antenna assemblies' electrical connectors may be accomplished by installers without the installers having to route wiring or cabling through antenna mounting holes in vehicle body walls. Accordingly, the pluggable electrical connections may be easily accomplished without requiring any particular technical and/or skilled operations on the part of the installers. Alternative embodiments, however, may include using other types of electrical connectors and communication links, besides standard ISO electrical connectors, Fakra connectors, and coaxial cables.

In still other exemplary embodiments, antenna assemblies may include a protective environmental covers as well as outer decorative covers that may provide aesthetically pleasing appearances to the antenna assemblies.

In addition, various antenna assemblies (e.g., 100, 200, etc.) disclosed herein may be mounted to a wide range of supporting structures, including stationary platforms and mobile platforms. For example, an antenna assembly (e.g., 100, 200, etc.) disclosed herein could be mounted to supporting structure of a bus, train, aircraft, bicycle, motorcycle, boat, among other mobile platforms. Accordingly, references to vehicles, vehicle body walls, motor vehicles, or automobiles herein should not be construed as limiting the scope of the present disclosure to any specific type of supporting structure or environment. Vehicle body walls may include, for example, supporting structure of a bus, train, aircraft, bicycle, motorcycle, boat, among other mobile platforms.

Various exemplary embodiments disclosed herein include resiliently compressible members or bumpers (e.g., silicone bumpers, etc.) for mechanical compression to aid in electrically grounding a shield (e.g., an EMI/RFI shield of an LNA/antenna element assembly, etc.) to a base or chassis (e.g., a metal chassis, etc.). By using resiliently compressible bumpers or members, various exemplary embodiments thus allow for the elimination of the conventional screws that are used in some existing antenna assemblies for mechanically fastening an LNA/antenna element assembly to a base or chassis. Eliminating the need for mechanical fastening of the LNA/antenna element assembly to the base or chassis may allow antenna assemblies to have smaller footprints since there is no longer a need to accommodate the mechanical fasteners (often requiring a larger footprint). Moreover, eliminating the need for mechanical fastening of the LNA/antenna element assembly to the base or chassis may make production of antenna assemblies less costly and less labor intense.

Certain terminology is used herein for purposes of reference only, and thus is not intended to be limiting. For example, terms such as "upper", "lower", "above", "below", "upward", "downward", "forward", and "rearward" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. An antenna assembly suitable for installation to a vehicle body wall, the antenna assembly comprising:

a chassis;

a radome;

a shield disposed generally between the chassis and radome; and two or more resiliently compressible bumpers spaced apart and compressively sandwiched generally between the radome and the shield, whereby compression of the bumpers generates a compressive force urging the shield generally towards the chassis that aids in electrically grounding of the shield with the chassis.

2. The antenna assembly of claim 1, wherein the bumpers comprise silicone.

3. The antenna assembly of claim 1, wherein:

the radome includes a forward portion and a rearward portion; and the two or more resiliently compressible bumpers includes two bumpers coupled to the forward portion and one bumper coupled to rearward portion.

4. The antenna assembly of claim 1, wherein the radome includes sockets engagingly receiving the bumpers.

5. The antenna assembly of claim 1, further comprising mechanical fasteners fastening the chassis to the radome, and wherein the compressive force is generated by the compression of the bumpers generally between the chassis and the radome when the chassis and the radome are relatively positioned adjacent to each other to be fastened via said mechanical fasteners.

6. The antenna assembly of claim 1, further comprising a low noise amplifier disposed generally between the shield and the radome.

7. The antenna assembly of claim 6, wherein the low noise amplifier is retained between the shield and the radome without any mechanical fasteners directly fastening the low noise amplifier to the chassis such that the compression of the resiliently compressible members generates the compressive force without any mechanical fasteners directly fastening the low noise amplifier to the chassis.

8. The antenna assembly of claim 7, further comprising mechanical fasteners directly fastening the radome to the chassis.

9. The antenna assembly of claim 1, further comprising a stacked patch assembly disposed generally between the shield and the radome, the stacked patch assembly including:

a lower patch-antenna tuned to a first frequency; and an upper patch-antenna tuned to a second frequency.

10. The antenna assembly of claim 9, wherein:

the first frequency is associated with a satellite digital radio service; and the second frequency is associated with a global positioning system.

11. The antenna assembly of claim 9, further comprising a low noise amplifier for amplifying signals received by the stacked patch assembly.

12. The antenna assembly of claim 9, further comprising at least one terrestrial antenna for reception of terrestrial signals.

13. A vehicle comprising the antenna assembly of claim 1.

14. The antenna assembly of claim 1, further comprising a mounting assembly for mounting the antenna assembly to a vehicle wall after being positioned relative to a mounting hole in the vehicle wall from an external side of the vehicle and nipped from an interior compartment side of the vehicle wall.

15. An antenna assembly mountable on a vehicle wall after being positioned relative to a mounting hole in the vehicle wall from an external side of the vehicle and nipped from an interior compartment side of the vehicle, the antenna assembly comprising:

a chassis;

a radome configured to be coupled to the chassis such that an interior enclosure is collectively defined by the radome and the chassis;

a shield disposed within the interior enclosure;

two or more spaced-apart resiliently compressible members coupled to the radome;

a first patch-antenna tuned to a first frequency;

a second patch-antenna tuned to a second frequency; and a low noise amplifier within the interior enclosure for amplifying signals received by the first and second patch-antennas;

whereby compression of the resiliently compressible members generates a compressive force urging the shield generally towards the chassis that aids in electrically grounding of the shield with the chassis.

16. The antenna assembly of claim 15, wherein:

the first frequency is associated with a satellite digital radio service; and the second frequency is associated with a global positioning system.

17. The antenna assembly of claim 15, further comprising at least one terrestrial antenna for reception of terrestrial signals.

18. The antenna assembly of claim 15, wherein the low noise amplifier is retained within the interior enclosure without any mechanical fasteners directly fastening the low noise amplifier to the chassis such that the compression of the resiliently compressible members generates the compressive force without any mechanical fasteners directly fastening the low noise amplifier to the chassis.

19. A method relating to installation of an antenna assembly to a vehicle wall, the antenna assembly including a chassis, a radome configured to be coupled to the chassis such that an interior enclosure is collectively defined by the radome and the chassis, a shield disposed within the interior enclosure, and an antenna element within the interior enclosure, the method comprising:

positioning two or more resiliently compressible bumpers at spaced apart locations generally between the radome and the shield; and compressing the bumpers by relatively moving the radome towards the chassis to thereby generate a compressive force urging the shield generally towards the chassis that aids in electrically grounding of the shield with the chassis.

20. The method of claim 19, further comprising mechanically fastening the chassis to the radome after compressing the bumpers.

* * * * *